US005477036A

United States Patent [19]

Jun et al.

[11] Patent Number: 5,477,036

[45] Date of Patent: Dec. 19, 1995

[54] MICROWAVE OVEN WITH A COOLING ARRANGEMENT

[75] Inventors: Wookeum Jun; Byeongjun Kim; Jintae Kim, all of Incheon; Wonpyo Hong, Kyungki-Do; Sangjin Kim, Incheon; Byungkap Lim, Seoul; Heungdae Kang, Incheon; Jaewon Cho, Seoul, all of Rep. of Korea

[73] Assignee: Daewoo Electronics Co., Ltd., Seoul, Rep. of Korea

[21] Appl. No.: 360,878

[22] Filed: Dec. 21, 1994

[30] Foreign Application Priority Data

May 14, 1994 [KR] Rep. of Korea ..... 94-10701 U

[51] Int. Cl.[6] ..... H05B 6/64

[52] U.S. Cl. ..... 219/757; 126/21 A

[58] Field of Search ..... 219/757, 681, 219/400; 126/21 A

[56] References Cited

U.S. PATENT DOCUMENTS

| | | | |
|---|---|---|---|
| 4,334,137 | 6/1982 | Takagi et al. | 219/757 |
| 4,498,453 | 2/1985 | Ueda | 126/21 A |
| 4,627,409 | 12/1986 | Kagomoto | 219/400 |
| 5,029,519 | 7/1991 | Boyen | 219/400 |

FOREIGN PATENT DOCUMENTS

| | | | |
|---|---|---|---|
| 3-25220 | 2/1991 | Japan | 219/757 |
| 5-106848 | 4/1993 | Japan | 219/757 |
| 5-106849 | 4/1993 | Japan | 219/757 |

*Primary Examiner*—Philip H. Leung
*Attorney, Agent, or Firm*—Lowe, Price, Leblanc & Becker

[57] ABSTRACT

Disclosed is a cooling device of a microwave oven which can be easily assembled on a rear wall of a microwave oven with reduced noise, improved cooling efficiency, and increased space efficiency of a machine chamber thereof. The cooling device has a fan cover disposed on the rear wall and having a plurality of pores formed therein. Side panels of the fan cover extend inward with such an inclination that the inner surfaces of the side panels confront a cooling fan. The fan cover protrudes backward from the machine chamber, and has a dent replacing a separate spacer for ensuring the introduction of air through the pores regardless of the place at which the microwave oven is installed.

6 Claims, 4 Drawing Sheets

MICROWAVE OVEN WITH A COOLING ARRANGEMENT

BACKGROUND OF THE INVENTION

1. Field of the Invention

The present invention relates to a microwave oven, and more particularly to a microwave oven having a cooling arrangement which can be easily assembled and fabricated on a rear wall of the microwave oven with reduced noise, improved cooling efficiency, and increased space efficiency of a machine chamber thereof.

2. Description of the Prior Art

In general, a microwave oven has a heating chamber for heating food, and a machine chamber for supplying heat into the heating chamber. Numerous components such as a magnetron to generate heat of high temperature into the heating chamber are provided in the machine chamber. Since a large quantity of high-temperature heat is produced by not only the magnetron but also such components as a high voltage transformer and the like while the microwave oven is operated, it may be necessary to introduce air into the machine chamber in order to cool these components. Further, introduction of air into the machine chamber can also be necessary according to cooking modes of the microwave oven.

In order to cool the magnetron or ventilate the heating chamber as described above, in the machine chamber are disposed a fan motor and a cooling fan rotated by the fan motor to blow air into the machine chamber.

Referring to FIGS. 1 through 3 schematically showing a construction of a conventional cooling arrangement of a microwave oven device having a fan motor, there are disposed a magnetron 12, a high voltage transformer 11, and numerous components (not shown) such as a PCB substrate and a high voltage condenser and the like in a machine chamber 10. Plural pores 31 are formed on a rear wall 20 of machine chamber 10. A fan motor 32 is fixed on a middle portion of pores 31 by a screw and the like, and a cooling fan 33 is fixed on the rotation shaft of fan motor 32. A wind guide 34 is fixedly disposed on rear wall 20 to surround the upper, lower and front sides of cooling fan 33 and fan motor 32, and has an opening formed at the center thereof in alignment with cooling fan 33 in order for wind to pass therethrough.

In the above described conventional cooling arrangement, as shown in FIG. 2, when fan motor 32 has been activated, air is introduced through plural pores 31 and the opening formed on wind guide 34 into machine chamber 10. At that time, the air is concentrated on cooling fan 33 disposed at the center thereof making noise due to compression of the air. Besides, the introduced air may cause bigger noise because the stream of the air is at a slant and thereby the rim of respective pore 31 interferes with the stream of the introduced air. In this case, the nearer the outer periphery of the rear wall the pores are, the greater the slant of the stream of and the resistance to the air passing through the pores are and thereby the bigger the noise is.

Meanwhile, after the cold air having been introduced into machine chamber 10 by the rotation of the cooling fan 33 cools high voltage transformer 11 and magnetron 12, a part of the air is introduced into the heating chamber, and the rest of the air flows in machine chamber 10 for cooling the exterior of the heating chamber, and then is exhausted through exhaust holes formed on the rear wall and a base plate of the microwave oven. However, since the opposite sides of wind guide 34 are open, the heated air obtained by cooling high voltage transformer 11 and magnetron 12 in the machine chamber is re-introduced into the back of cooling fan 33 and blown by cooling fan 33 again, so as to make the cooling efficiency of the cooling arrangement considerably reduced.

Further, in the conventional device, cooling fan 33 and fan motor 32 surrounded by wind guide 34 are disposed in machine chamber 10 to occupy much space of machine chamber 10, and accordingly it is difficult to assemble them in machine chamber 10 due to interference of the neighboring components such as the magnetron, high voltage transformer, high voltage condenser, and the like.

Moreover, the back of the microwave oven should not be in close contact with a neighboring wall or other obstacles in order for the exterior air to flow thereinto. Therefore, a spacer 40 for ensuring a minimum space between the neighboring obstacles and the back of the microwave oven should be provided in the cooling arrangement as shown in FIG. 3.

To manufacture rear wall 20 having a plurality of pores 31, five complicated steps must be performed as follows:

drawing, cutting, notching, and piecing the rear wall in order for other plates to be assembled thereon;

pressing the notched and pieced rear wall to perforate pores therein, which pressing process is repeated three times because the pores are concentrated in a limited area and formed directly at the rear wall of the microwave oven; and bending the edges of the perforated rear wall to complete the manufacture of the rear wall.

Therefore, the number of manufacturing steps of the rear wall is so large that the manufacturing cost thereof is increased and accordingly the quality thereof is deteriorated.

SUMMARY OF THE INVENTION

The present invention is intended to overcome the above-discussed and numerous other disadvantages and deficiencies of the prior art.

Therefore, it is an object of the present invention to provide a microwave oven with a cooling arrangement which is easily assembled and fabricated on a rear wall of a microwave oven, in which air having circulated in the machine chamber or the heating chamber is prevented from being re-blown into the machine chamber, so that cooling efficiency is improved, and in which noise due to the introduced air is reduced, and space redundancy in a machine chamber is increased.

To achieve the above object, the present invention provides a microwave oven having:

a housing including a heating chamber for heating food put therein and a machine chamber accommodating components for supplying microwave energy into the heating chamber, and an arrangement for cooling the machine chamber, the arrangement comprising a rear wall having an opening formed at the center thereof through which air can be introduced into the machine chamber;

a fan cover covering the opening, the fan cover including a rear panel, at least one side panel being formed integrally with an outer periphery of the rear panel, a flange disposed in parallel with the rear wall and formed integrally with an inner end of the side panels, and a plurality of pores for enabling the air to pass through the fan cover from the exterior;

a fan motor fixed on an inner surface of the rear panel;

a cooling fan fixed on a rotation shaft of the fan motor and accommodated in the opening.

According to one embodiment of the present invention, the rear wall of the machine chamber further comprises a plurality of engagement holes and screw holes, and a sleeve protruding from an inner circumference of the opening into the machine chamber, the plurality of pores are formed throughout the rear panel and the side panels, and each of the side panels is disposed at an angle to the rear panel so that the inner surfaces of side panels confront cooling fan.

Further, the rear panel may be quadrilateral, and the side panels respectively are formed integrally with each of four sides of the rear panel and are formed integrally with each other.

The rear panel has a dent formed at the center thereof, and the bracket has a protuberance formed at the rear center thereof to be inserted in the dent.

According to another embodiment of the present invention, the rear wall further has two engagement holes formed above the opening, and the fan cover further has two elastic hooks to be engaged in the two engagement holes.

In the microwave oven with a cooling arrangement according to the present invention as described above, the stream lines of the air passing through the pores of the side panels are nearly linear, and thereby resistance to air-flow through the rims of the pores and vortex of the air thereat are reduced, so that the introduced air can smoothly pass through the pores with greatly reduced noise.

Further, the air having circulated in the machine chamber can not be returned to the cooling fan by the interruption of the sleeve and only the air introduced from the exterior of the oven is blown by the cooling fan while the cooling fan is operated. That is, the air in the machine chamber and the outer air are completely separated from each other. Therefore, because the warmed air having circulated in the machine chamber is prevented from being re-blown by the cooling fan 133, the cooling arrangement of the present invention has far higher cooling efficiency than the conventional cooling arrangement has.

In the above described cooling arrangement of the present invention, because the middle part of the fan cover protrudes backward due to the dent formed at the inner surface of the fan cover, not the entire microwave oven but only the middle part of the fan cover can be in contact with the neighboring construction. Therefore, a separate spacer for ensuring the introduction of air through the pores is unnecessary, and thereby sufficient air can be introduced into the machine chamber through the pores of the fan cover regardless of the place at which the microwave oven is installed.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE PREFERRED EMBODIMENTS

Hereinafter, several preferred embodiments of the present invention will be described in detail with reference to the accompanying drawings.

Figure 1:
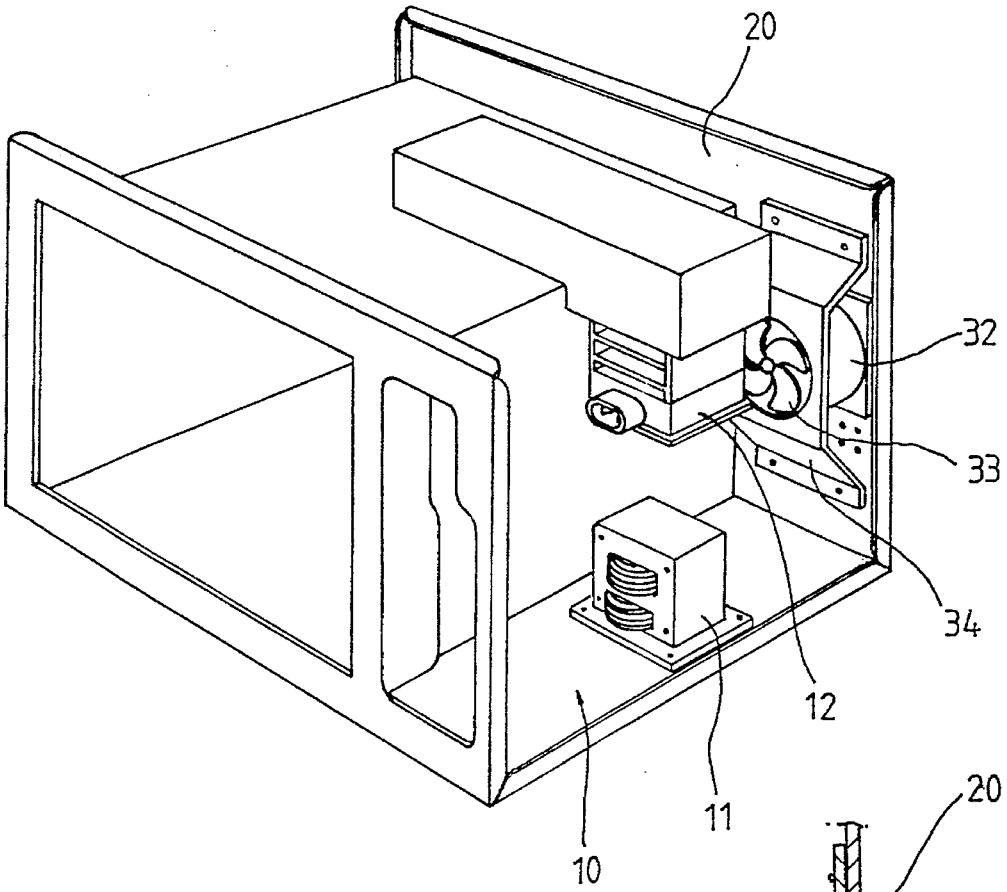
FIG. 1 (PRIOR ART)
FIG. 1 is an exploded perspective view for illustrating a conventional cooling arrangement of a microwave oven.
Figure 2:
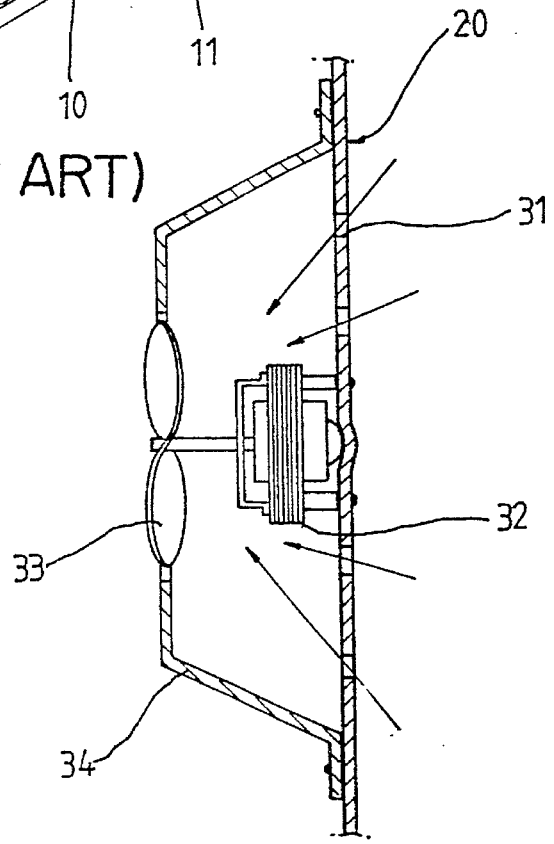
FIG. 2 (PRIOR ART)
FIG. 2 is a side sectional view for illustrating the cooling arrangement shown in FIG. 1.
Figure 3:
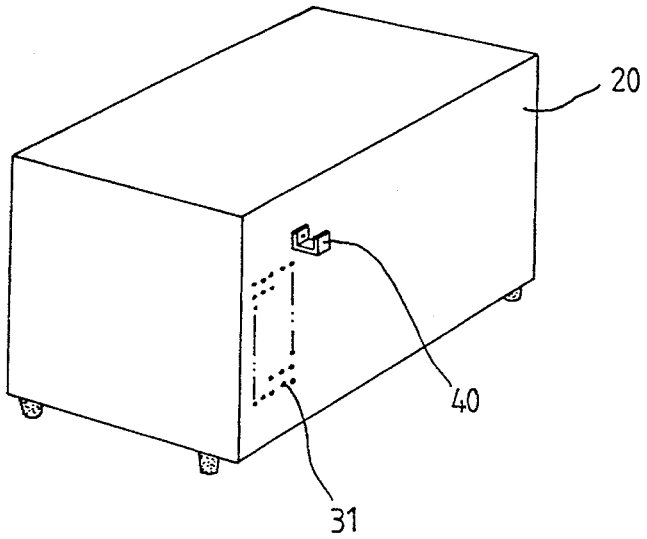
FIG.3 (PRIOR ART)
FIG. 3 is a rear perspective view for illustrating a microwave oven having the cooling arrangement shown in FIG. 1.
Figure 4:
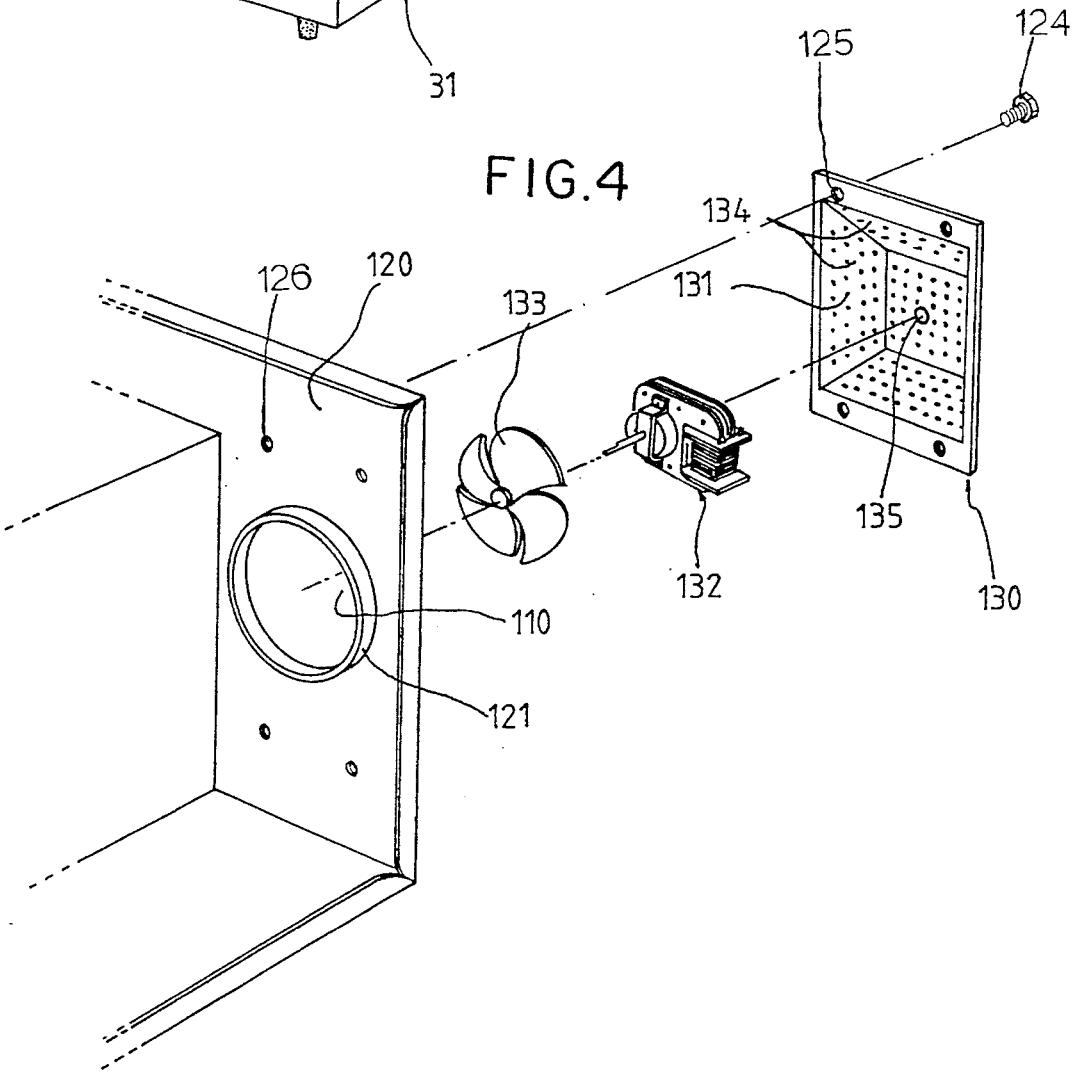
FIG. 4 is an exploded perspective view for illustrating a cooling arrangement of a microwave oven according to an embodiment of the present invention.
Figure 5:
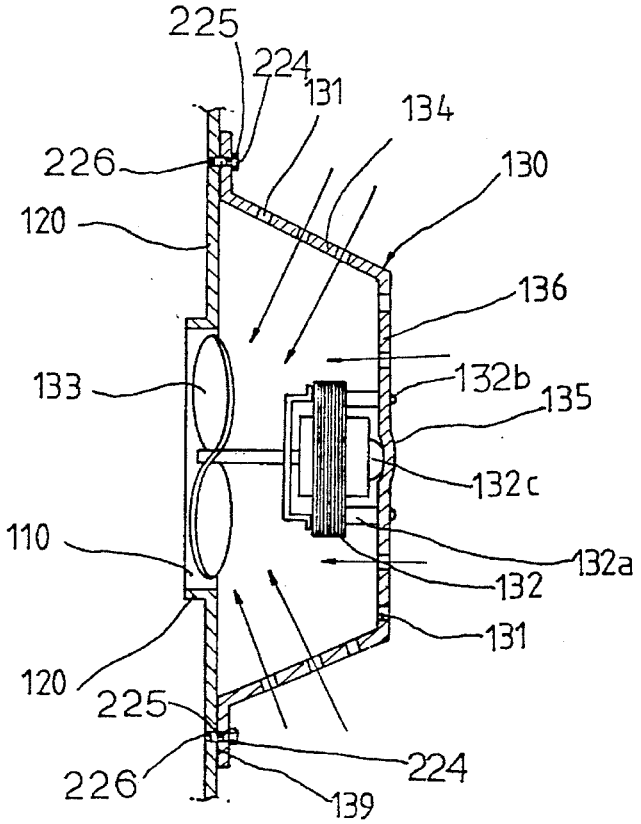
FIG. 5 is a side sectional view for illustrating the cooling arrangement shown in FIG. 4.
Figure 6:
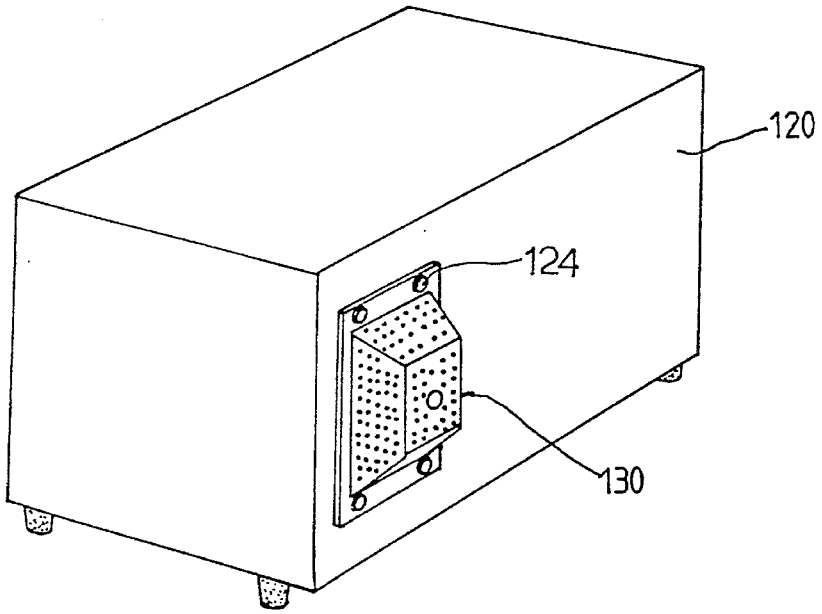
FIG. 6 is a rear perspective view for illustrating a microwave oven having the cooling arrangement shown in FIG. 4.

Referring to FIG. 4 showing an exploded perspective view of a cooling arrangement of a microwave oven according to an embodiment of the present invention, a circular opening 110 is formed on a rear wall 120 of a machine chamber 100 constituting an outer case of the microwave oven. A cylindrical sleeve 121 protrudes from the inner circumference of opening 110 into machine chamber 100. A plurality of first screw holes 126 are formed around opening 110.

A fan cover 130 is disposed on the exterior of rear wall 120 to cover opening 110. Fan cover 130 has a rectangular rear panel 136, four side panels 134 formed integrally with each other and respectively being formed integrally with each of the four sides of rear panel 136, and a flange 139 extending in parallel with rear wall 120 from the inner ends of side panels 134. Rear and four side panels 136 and 134 respectively have a plurality of pores 131 formed therein. A plurality of second screw holes 125 corresponding to first screw holes 126 are formed in flange 139.

Fan cover 130 is fixed on rear wall 120 by proper elements such as screws or bolts 124 as shown in FIG. 4 which are fitted in first screw holes 126 through second screw holes 125 of flange 139. In this case, rear panel 136 is spaced a predetermined distance apart from rear wall 120.

A fan motor 132 is fixed on the inner surface of rear panel 136, and a cooling fan 133 fixed on the rotation shaft of fan motor 132 is disposed in opening 110.

Four side panels 134 at upper, lower, left, and right sides of rear panel 134 respectively are disposed at an angle to rear panel 136 so that the inner surfaces of side panels confront cooling fan 133, so that the introduced air can smoothly pass through pores 131 formed in side panels 134 with little resistance.

When the above cooling arrangement of a microwave oven according to the present embodiment is assembled, fan motor 132 and fan 133 fixed thereto are firstly assembled on the inner surface of fan cover 130 through a boss **132*a*, and then first and second screw holes 126 and 125 are aligned with each other so that cooling fan 133 fixed on the rotation shaft of fan motor 132 is accommodated in opening 110 of rear wall 120. Then, bolts 124 are fitted through aligned first and second screw holes 126 and 125, so that fan cover 130 is fixed on rear wall 120**.

Meanwhile, pores 131 are circular in the present embodiment, but may be elongated slits or louvers.

Fan motor 132 is fixed on the inner surface of rear panel 136 by screws **132*b* fitted through bosses 132*a*, and rear panel 136 has a dent 135 formed at the center thereof. The bracket has a protuberance 132*c* formed at the rear center thereof to be inserted in dent 135**.

Fan cover 130 may be made by processing a metal plate, or by injection-molding a resin having high strength, heat-resistance, and resistance-to-combustion. When fan cover 130 is made by a metal plate, separate boss 132*a* and spacer 132*b* can be used to fix fan motor 132 on fan cover 130. Otherwise, boss 132*a* and spacer 132*b* can be injection-molded with being incorporated with fan cover 130 when fan cover 130 is made by injection molding.

Meanwhile, rear wall 120 constituting the case of the microwave oven can be manufactured through only three simple manufacturing steps of:

drawing; notching/piecing for defining various screw holes and opening 110 having sleeve 121, and in order for other members assembled thereon; and bending the edges of the rear wall to complete the manufacture of the rear wall.

Figure 7:
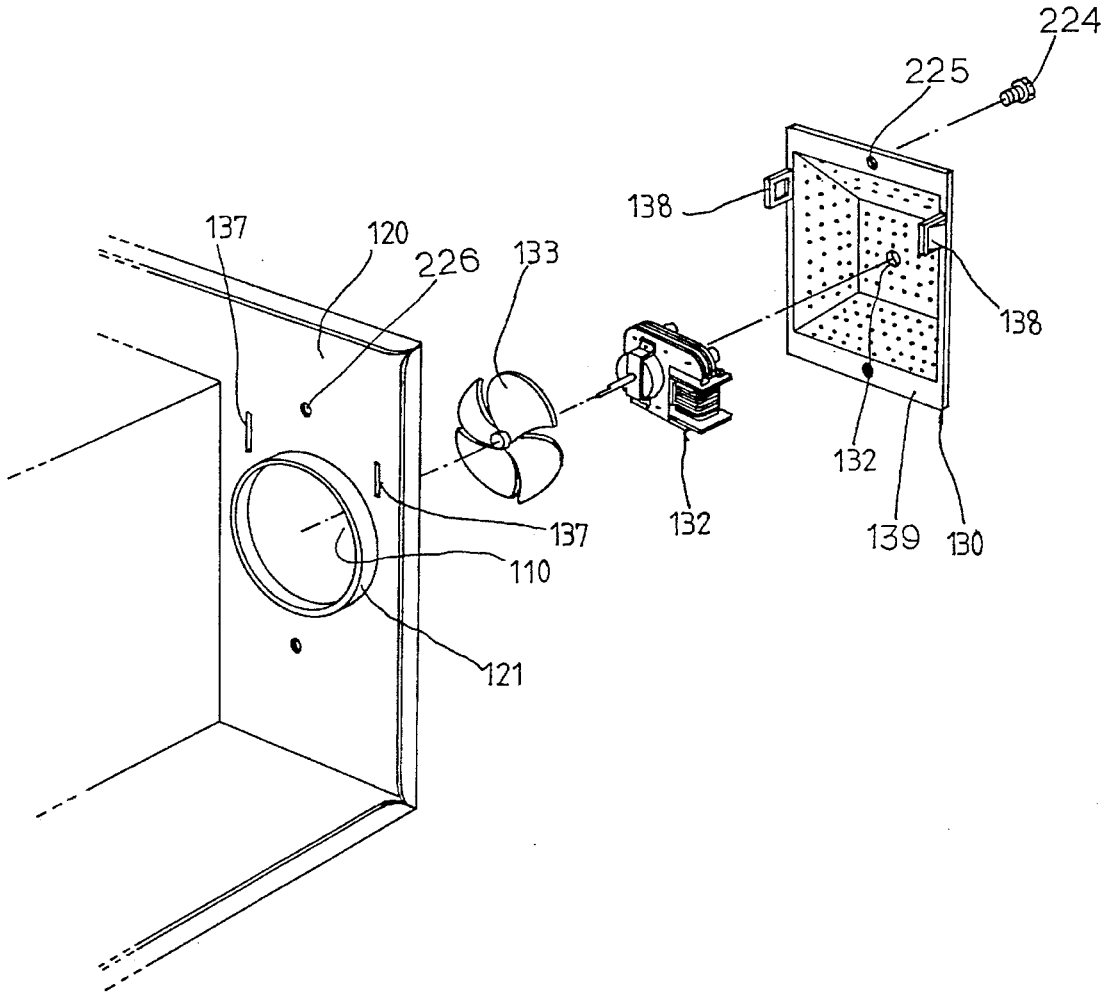
FIG. 7 is an exploded perspective view for illustrating a cooling arrangement of a microwave oven according to another embodiment of the present invention.

Referring to FIG. 7 showing another cooling arrangement of a microwave oven according to another embodiment of the present invention, rear wall 120 has two engagement holes 137 formed above opening 110, and fan cover 130 has two elastic hooks 138 protruding from the opposite side ends thereof which can be fitted in engagement holes 137.

A plurality of first screw holes 226 are formed around opening 110 of rear wall 120 and a plurality of second screw holes 225 corresponding to first screw holes 226 are formed in flange 139.

When the cooling arrangement of a microwave oven according to the present embodiment is assembled, fan motor 132 and fan 133 fixed thereto are firstly assembled on the inner surface of fan cover 130 through a boss 132*a*, and then hooks 138 of fan cover 130 are engaged in engagement holes 137 of rear wall 120. In this case, first and second screw holes 226 and 225 are aligned with each other, and cooling fan 133 fixed on the rotation shaft of fan motor 132 is accommodated in opening 110 of rear wall 120. Then, bolts 224 are fitted through aligned first and second screw holes 226 and 225, so that fan cover 130 is fixed on rear wall 120.

In the cooling arrangement of a microwave oven according to the present invention, because fan cover 130 is assembled on the outer surface of rear wall 120 after fan motor 132 is fixed therein, there is no interference by neighboring components in assembling the cooling arrangement, and accordingly the assembly can be easily performed. And, space for installing components having large volume such as a magnetron, a high voltage transformer, and a high voltage condenser, is sufficiently ensured in machine chamber, and thereby layout of machine chamber comes to be far freer.

Further, because the middle part of fan cover 130 protrudes backward due to dent 135 formed at the inner surface of fan cover 130, not the entire microwave oven but only the middle part of fan cover 130 can be in contact with the neighbor construction. That is, because dent 135 functions as a spacer, a separate spacer for ensuring the introduction of air through pores 131 is unnecessary, and thereby sufficient air can be introduced into the machine chamber through pores 131 of fan cover 130 regardless of the place at which the microwave oven is installed.

Furthermore, because side panels 134 are disposed at an angle to the rear panel 136 so that the inner surfaces of side panels confront cooling fan 133 so that pores 131 at not only rear panel 136 but also side panels 134 are directed toward cooling fan 133, the stream lines of the air passing through pores 131 of side panels 134 are also directed toward cooling fan 133 and are nearly linear, and thereby resistance to air-flow through the rims of pores 131 and vortex of the air thereat are reduced, so that the introduced air can smoothly pass through pores 131 with greatly reduced noise.

In the cooling arrangement of a microwave oven according to the present invention, because cooling fan 133 is accommodated in opening 110 of rear wall 120 and sleeve 121 protrudes inward from the inner circumference of opening 110, the air having circulated in the machine chamber can not be returned to cooling fan 133 by the interruption of sleeve 121 and only the air introduced from the exterior of the oven is blown by cooling fan 133, while cooling fan is operated. That is, the air in the machine chamber and the outer air are completely separated from each other. Then, a part of air having cooled the magnetron and other components flows into the heating chamber through a duct which is not shown, while the rest of air flows along the outer wall of the heating chamber while cooling the heating chamber and then is exhausted out through exhaust pores which are formed at the rear wall or the lower plate of the heating chamber and also not shown in the figures. Therefore, because the warmed air having circulated in the machine chamber is prevented from being re-blown by cooling fan 133 and only the air introduced from the exterior of the oven is blown by cooling fan 133, the cooling arrangement of the present invention has far higher cooling efficiency than that of the conventional cooling arrangement.

As described above in detail, according to the present invention, there is provided a cooling arrangement having far improved cooling efficiency, because sufficient cooling air can be introduced into the cooling arrangement of the present invention without a separate spacer for ensuring a minimal space behind the microwave oven regardless of the place the oven is installed, and because the warmed air having circulated in the machine chamber is prevented from being re-blown by cooling fan 133. Further, in the cooling arrangement of the present invention, noise generated by the introduced air is greatly reduced, space redundancy in the machine chamber is increased, and various components can be easily assembled and installed.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A microwave oven having a housing including a heating chamber for heating food put therein and a machine chamber accommodating components for supplying microwave energy into the heating chamber, and a device for cooling the machine chamber, wherein the device comprises:

a rear wall disposed behind the machine chamber, the rear wall having an opening formed at the center thereof through which an air can be introduced into the machine chamber, a plurality of first screw holes, and a sleeve protruding from an inner circumference of the opening into the machine chamber;

a fan cover covering the opening, the fan cover including a quadrilateral rear panel, four side panels respectively being formed integrally with each of four sides of the rear panel and being formed integrally with each other, a flange disposed in parallel with the rear wall and formed integrally with inner ends of the side panels, and a plurality of pores formed throughout the rear panel and the side panels to enable the air to pass through the fan cover from exterior, the rear panel having a dent formed at the center thereof, the flange having second screw holes corresponding to the first screw holes;

a fan motor fixed on an inner surface of the rear panel while being inserted in a bracket by a screw or a bolt, the bracket having a protuberance formed at the rear center thereof to be inserted in the dent; and a cooling fan fixed on a rotation shaft of the fan motor and accommodated in the opening, each of the side panels disposed at an angle to the rear panel so that the inner surfaces of the side panels confront the cooling fan, and the fan cover being assembled on the rear wall by bolts or screws fitted through the first and second screw holes, so that the rear panel is disposed behind the rear wall while being spaced a predetermined distance apart therefrom.

2. A microwave oven of claim 1, wherein said rear panel is square.

3. A microwave oven of claim 1, wherein said angle of each of said four side panels to the rear panel is equal to those of the rest side panels.

4. A microwave oven having a housing including a heating chamber for heating food put therein and a machine chamber accommodating components for supplying microwave energy into the heating chamber, and a device for cooling the machine chamber, wherein the device comprises:

a rear wall disposed behind the machine chamber, the rear wall having an opening formed at the center thereof through which an air can be introduced into the machine chamber, a plurality of first screw holes, two engagement holes, and a sleeve protruding from an inner circumference of the opening into the machine chamber;

a fan cover covering the opening, the fan cover including a quadrilateral rear panel, four side panels respectively being formed integrally with each of four sides of the rear panel and being formed integrally with each other, a flange disposed in parallel with the rear wall and formed integrally with inner ends of the side panels, two elastic hooks to be engaged in the two engagement holes, and a plurality of pores formed throughout the rear panel and the side panels to enable the air to pass through the fan cover from exterior, the rear panel having a dent formed at the center thereof, the flange having second screw holes corresponding to the first screw holes;

a fan motor fixed on an inner surface of the rear panel while being inserted in a bracket by a screw or a bolt, the bracket having a protuberance formed at the rear center thereof to be inserted in the dent; and a cooling fan fixed on a rotation shaft of the fan motor and accommodated in the opening, each of the side panels disposed at an angle to the rear panel so that the inner surfaces of said side panels confront the cooling fan, and the fan cover being assembled on the rear wall by bolts or screws fitted through the first and second screw holes, so that the rear panel is disposed behind the rear wall while being spaced a predetermined distance apart therefrom.

5. A microwave oven of claim 4, wherein said rear panel is square.

6. A microwave oven of claim 4, wherein said angle of each of said four side panels to the rear panel is equal to those of the rest side panels.

* * * * *